US008357028B2

(12) United States Patent
Jeevanantham et al.

(10) Patent No.: US 8,357,028 B2
(45) Date of Patent: Jan. 22, 2013

(54) SELF-BONDED FOAMED ABRASIVE ARTICLES AND MACHINING WITH SUCH ARTICLES

(75) Inventors: Muthu Jeevanantham, Worcester, MA (US); Xavier Orlhac, Saint Chely d'Apcher (FR)

(73) Assignees: Saint-Gobain Abrasive, Inc., Worcester, MA (US); Saint-Gobain Abrasifs, Conflans-Saint-Honorine (FR)

( * ) Notice: Subject to any disclaimer, the term of this patent is extended or adjusted under 35 U.S.C. 154(b) by 786 days.

(21) Appl. No.: 12/484,059

(22) Filed: Jun. 12, 2009

(65) Prior Publication Data

US 2009/0311946 A1 Dec. 17, 2009

Related U.S. Application Data

(60) Provisional application No. 61/061,471, filed on Jun. 13, 2008.

(51) Int. Cl.
*B24D 18/00* (2006.01)
*B24B 1/00* (2006.01)

(52) U.S. Cl. ..... 451/59; 51/296; 451/526

(58) Field of Classification Search ..... 51/296, 51/309; 451/59, 342, 526, 527, 541, 548
See application file for complete search history.

(56) References Cited

U.S. PATENT DOCUMENTS

| | | | | |
|---|---|---|---|---|
| 2,964,823 | A | 12/1960 | Fredriksson | |
| 4,024,212 | A | 5/1977 | Dore et al. | |
| 4,124,667 | A | 11/1978 | Coppola et al. | |
| 4,312,954 | A | 1/1982 | Coppola et al. | |
| 4,937,062 | A | 6/1990 | Jordan et al. | |
| 5,160,509 | A * | 11/1992 | Carman et al. | 51/307 |
| 5,221,294 | A | 6/1993 | Carman et al. | |
| 5,399,535 | A | 3/1995 | Whitman | |
| 5,562,745 | A | 10/1996 | Gagliardi et al. | |
| 5,643,512 | A | 7/1997 | Daws et al. | |
| 5,705,448 | A | 1/1998 | Sambrook et al. | |
| 5,738,697 | A | 4/1998 | Wu et al. | |
| 6,007,590 | A | 12/1999 | Sanders, Jr. | |
| 6,881,483 | B2 * | 4/2005 | McArdle et al. | 428/403 |
| 2002/0050233 | A1 | 5/2002 | Balkum | |
| 2006/0128288 | A1 | 6/2006 | An et al. | |
| 2006/0160476 | A1 | 7/2006 | Bright | |
| 2011/0045739 | A1 * | 2/2011 | Keijzer et al. | 451/5 |

FOREIGN PATENT DOCUMENTS

| | | | |
|---|---|---|---|
| EP | 330963 | A2 | 9/1989 |
| EP | 759020 | B1 | 3/1999 |
| EP | 1140731 | B1 | 2/2003 |
| EP | 1329439 | A1 | 7/2003 |
| JP | 2005-522339 | A | 7/2005 |

(Continued)

OTHER PUBLICATIONS

Piotrowski, Gerald. "Surface Finish Cross Reference Chart (Illinois)" Finishing.com, Feb. 28, 2008. <www.finishing.com/204/90.shtml>.

(Continued)

*Primary Examiner* — Timothy V Eley
(74) *Attorney, Agent, or Firm* — Abel Law Group, LLP; Joseph P. Sullivan

(57) ABSTRACT

A self-bonded foamed abrasive article and a method of machining using such an article. The machining method includes providing a workpiece having a worksurface and removing material from the worksurface by moving an abrasive relative to the worksurface, wherein the abrasive comprises a foamed abrasive body consisting of abrasive grains and a porosity of at least about 66 vol %.

18 Claims, 8 Drawing Sheets

FOREIGN PATENT DOCUMENTS

| | | | |
|---|---|---|---|
| JP | 2008-030194 | A | 2/2008 |
| WO | 03/045634 | A1 | 6/2003 |
| WO | 03/086704 | A1 | 10/2003 |
| WO | 2006018536 | A1 | 2/2006 |
| WO | 2006018537 | A2 | 2/2006 |
| WO | 2006018537 | A3 | 2/2006 |

OTHER PUBLICATIONS

"Use with WAC 296-807-180, Portable Tools using Abrasive Wheels" Abrasive Wheel Illustrations.Resources, pp. R8-R21. <http://www.Ini.wa.gov/.

* cited by examiner

SELF-BONDED FOAMED ABRASIVE ARTICLES AND MACHINING WITH SUCH ARTICLES

CROSS-REFERENCE TO RELATED APPLICATION(S)

The present application claims priority from U.S. Provisional Patent Application No. 61/061,471, filed Jun. 13, 2008, entitled "SELF-BONDED FOAMED ABRASIVE ARTICLES AND MACHINING WITH SUCH ARTICLES," naming inventors Muthu Jeevanantham and Xavier Orlhac, which application is incorporated by reference herein in its entirety.

BACKGROUND

1. Field of the Disclosure

The following relates to abrasive articles for use in machining and more particularly use of foamed abrasives in machining processes.

2. Description of the Related Art

Abrasives used in machining applications typically include bonded abrasive articles and coated abrasive articles. Coated abrasive articles generally include a layered article including a backing and an adhesive coat to fix abrasive grains to the backing, the most common example of which is sand paper. Bonded abrasive tools consist of rigid, and typically monolithic, three-dimensional, abrasive composites in the form of wheels, discs, segments, mounted points, hones and other tool shapes, which can be mounted onto a machining apparatus, such as a grinding or polishing apparatus. Such bonded abrasive tools usually have three phases including abrasive grains, bond material, and porosity.

It has been shown that certain amounts of porosity within bonded abrasive structures can improve machining efficiency and protect the quality of the workpiece being machined from thermal or mechanical damage. However, manufacturing limitations and mechanical property requirements (e.g., strength) restrict the percentage of porosity, which is further dependent on the size of the grit, the presence of agglomerated abrasive grains, and the type of bond material.

Manufacturing techniques include use of pore formers, such as glass bubbles, organics, and the like in the bonded abrasive formation, since the natural porosity resulting from regular packing of the abrasive grains is generally insufficient to achieve high porosity. However, such pore formers tend to form closed pores and not the open porosity suitable for improving machining efficiency. In fact, the creation of excessive closed porosity can increase the machining forces necessary for effective material removal and increase the thermal damage to the workpiece. Moreover, the use of certain pore formers can require a subtractive process in which the pore formers are "burned out" of the abrasive article during forming, which gives rise to other manufacturing obstacles.

SUMMARY

In accordance with one embodiment, a method of machining includes providing a workpiece having a worksurface, and removing material from the worksurface by moving an abrasive relative to the worksurface, wherein the abrasive comprises a foamed abrasive body consisting of abrasive grains and a porosity of at least about 66 vol %. The porosity can be within a range between 75 vol % and 95 vol %, or more particularly within a range between about 77 vol % and about 90 vol %. In certain embodiments, the porosity is at least about 75 vol %, at least about 80 vol %, or at least 85 vol %. Additionally, the pores may have an average size of at least about 1 micron, and vary in size over a large range between about 10 microns and about 2000 microns. In certain instances, the self-bonded foamed abrasive body can be characterized in terms of large pore fractions, $PF_x$, representing the fraction of pores within the foamed abrasive article having an average diameter greater than "x" microns. In particular examples, the self-bonded foamed abrasive article has a $PF_{300}$ within a range between about 15% and about 50%. In one such case, the $PF_{300}$ is at least about 20%, or at least about 25%, or even at least about 30%. In other exemplary articles, the self-bonded foamed abrasive body has a $PF_{450}$ (i.e., fraction of pores having an average size greater than 450 microns) within a range between about 5% and about 30%. In more particular instances, $PF_{450}$ is at least about 10%, such as at least about 12%, or even at least about 15%. In one particular configuration, the foamed abrasive article has a $PF_{750}$ within a range between about 1% and about 10%. In certain other embodiments, $PF_{750}$ is not greater than about 8%, not greater than about 5%, or even not greater than about 2%.

The abrasive grains can be selected from the group of materials consisting of oxides, borides, nitrides, carbides, and any combination thereof. In certain other instances, the abrasive grains are alumina and silicon carbide, and in some cases the foamed abrasive body can consist essentially of alumina or silicon carbide.

The self-bonded foamed abrasive body can have a thickness greater than about 60 mm. Additionally the self-bonded foamed abrasive body can have a density within a range between about 0.3 g/cm$^3$ and 1.35 g/cm$^3$, such that the density is not greater than about 1.2 g/cm$^3$, or not greater than about 1.0 g/cm$^3$. The abrasive body can also be strong for its volume of porosity, such that for example, the Modulus of Rupture (MOR) of the self-bonded foamed abrasive body is within a range between about 1 MPa and about 20 MPa. For example, in certain configurations the MOR is at least about 5 MPa, or at least about 8 MPa.

In accordance with another embodiment, a method of polishing a workpiece using a self-bonded abrasive foam material includes providing a workpiece having a worksurface, and removing material from the worksurface by moving a foamed abrasive relative to the worksurface. The foamed abrasive includes a self-bonded abrasive body containing abrasive grains bonded to each other to form a rigid structure and at least about 70 vol % porosity forming a network of interconnected channels through the structure, the porosity including pores having an average size within a range between 10 microns and about 2000 microns, and a pore fraction of pores having an average diameter greater than 300 microns ($PF_{300}$) of at least about 15%.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
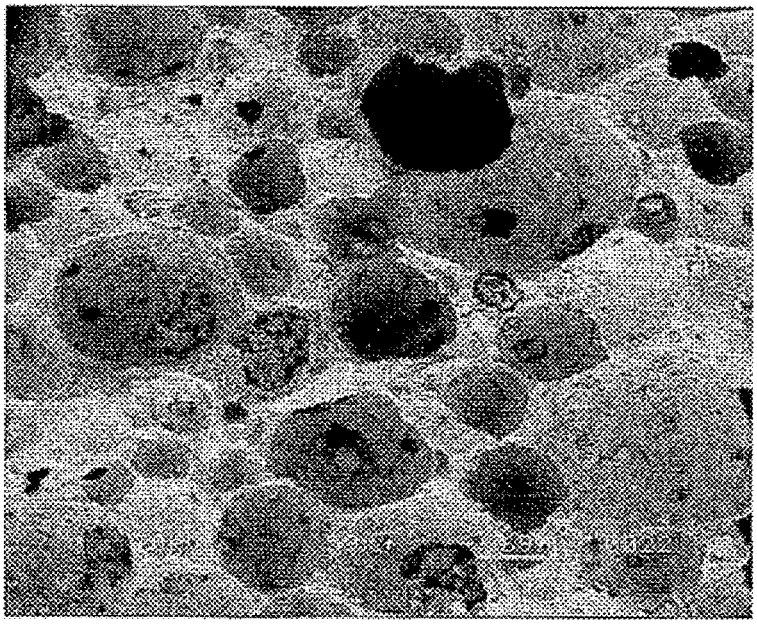
FIG. 1 illustrates a magnified image of a portion of a foamed abrasive in accordance with an embodiment.

The following disclosure is directed to an abrasive article suitable for machining applications. According to one embodiment, a foamed abrasive article is formed through a particular process such that the final abrasive article is a self-bonded foamed abrasive including abrasive grains bonded to each other without the use of a bond material (e.g., a vitreous bond material) commonly used in conventional bonded abrasives.

More specifically, the foamed abrasive article is formed by a particular process, without the use of pore formers or an underlying reticulated structure (e.g., sponge) upon which a ceramic slurry is formed. Formation of the article can be initiated by preparing a mixture containing abrasive particles in a slurry, at least one gelling agent, and at least one foaming agent. The mixture is mixed at a temperature greater than the gelling temperature of the gelling agent, such that gellation is avoided until a foam is obtained. Foaming introduces a large number of bubbles within the mixture, which will later form the porosity within the final foamed abrasive. After foaming, the mixture is shaped and cooled to form a partially solidified gelled foam body. After gellation, the mixture is dried and fired such that a foamed abrasive is obtained. Typically, the firing process includes sintering of the abrasive grains to bond them to each other at temperatures in excess of 1000° C. and within a range between about 1400° C. to about 2300° C. The thus formed, foamed abrasive can be formed into a variety of shapes, including those suitable for machining applications, such as a grinding or polishing wheel.

In accordance with a particular embodiment, a stabilizing agent is added to the mixture. The stabilizing agent is sensitive to particular shearing speeds, such that upon decreasing the mixing speed, the viscosity of the mixture can increase by an order of magnitude, to form a stable, foamed mixture, which then cools to form a gelled foam body. The gelled foam body is then heat treated to form the final foamed abrasive article. Such a process facilitates the formation of large, thick, foamed abrasive articles and is described in the publication WO 2006/018537, the disclosure of which is incorporated herein in its entirety.

In accordance with an embodiment, the foamed abrasive article can include abrasive grains having a suitable hardness to facilitate machining operations, such as grinding and polishing, and being capable of forming a self-bonded structure through heat treatment. In accordance with one particular embodiment, the abrasive grains can include ceramics such as oxides, borides, nitrides, carbides, and any combination thereof. In a more particular embodiment, the abrasive grains can include oxides and nitrides, and more particularly, alumina and silicon carbide. In certain embodiments, the abrasive grains of the foamed abrasive are entirely silicon carbide grains. Still, in other embodiments, the abrasive grains consist essentially of alumina grains.

The foamed abrasive articles described herein can be formed such that they are particularly robust, having a thickness suitable for use in machining and polishing applications. Accordingly, in one embodiment, the body of the foamed abrasive article has a thickness within a range between about 60 mm and about 200 mm. In certain other embodiments, the thickness of the foamed abrasive body is at least about 70 mm, such as at least about 80 mm, at least about 100 mm, or even at least about 125 mm.

According to an embodiment the foamed abrasive is a highly porous structure, and accordingly, has a particularly low density. In fact, the foamed abrasive articles described herein have a high degree of porosity, the majority of which is open porosity defining a network of interconnected channels through the structure. As such, in accordance with one embodiment, the foamed abrasive has a density within a range between about 0.3 g/cc$^3$ and about 1.35 g/cc$^3$. In certain other embodiments, the foamed abrasive has a density not greater than 1.2 g/cc$^3$, not greater than about 1.0 g/cc$^3$, or even not greater than about 0.75 g/cc$^3$.

An example of a self-bonded foamed abrasive article is manufactured by forming a mixture of an alumina powder using 99% pure alumina particles having a particle size distribution within a range of 0.1 microns to 200 microns, and present within the mixture at approximately 65 wt %. The mixture further includes 0.6 wt % of ammonium polyacrylate as a dispersant, 2.4 wt % gelatine as a gelling agent, and 0.1% of a stabilizing agent, such as xanthane provided as gum of xanthane or Satiaxane™ from SKW Biosystems. PVA sold as Rhodoviol 4/125 from Rhodia PMC is the foaming agent and is present in the mixture in an amount of 2.2 wt %. The mixture can also contain a plasticizer in a minor amount of 1.0 wt %, and the remainder of the mixture is water.

The formation of such a mixture is carried out by combining three separately formed mixtures, A, B, and C. Mixture A includes a slurry of the abrasive grains and water. Mixture B contains the gelling agent, stabilizer, and water, which is continuously mixed at a temperature above the gellation temperature of the gelling agent. Mixture C contains the foaming agent in water. The mixtures A and C are added to mixture B while mixture B is heated and agitated until a foamed mixture is obtained. The foamed mixture is shaped (e.g., by pouring into a mold) and cooled to form a gelled foam body, and subsequently dried and fired to form the thus formed product illustrated in the scanning electron microscopy images of FIGS. 1-3.

Figure 2:
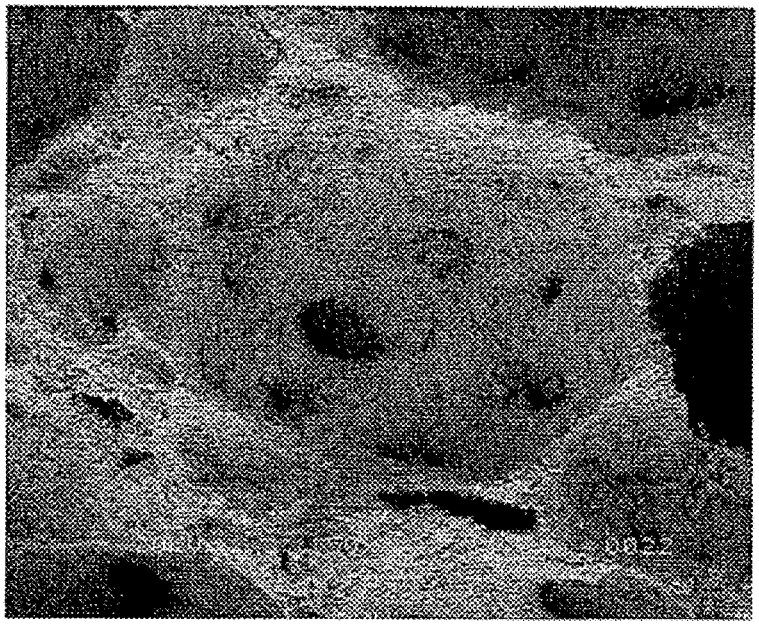
FIG. 2 illustrates a magnified image of a portion of a foamed abrasive in accordance with an embodiment.
Figure 3:
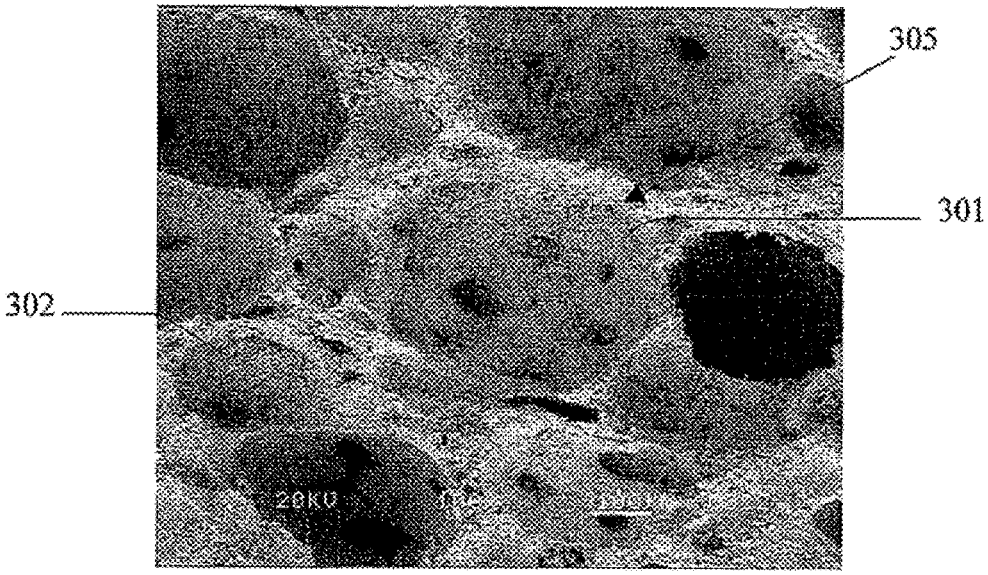
FIG. 3 illustrates a magnified image of a portion of a foamed abrasive in accordance with an embodiment.

FIGS. 1-3 provide magnified images of portions of a foamed abrasive article, notably illustrating the size and shape of the pores of the foamed abrasive article. The illustrated embodiments have an average pore size that is at least about 1 micron and a pore size within a range between about 10 microns and 2000 microns. The combination of different pore sizes facilitates a greater number of pores per unit volume facilitating improved packing efficiency of the pores, and thus a highly porous article.

As further illustrated in FIGS. 1-3, the porosity of the foamed abrasive article includes individually identifiable pores having substantially spherical shapes, which generally contact each other to form an interconnected network of pores. For example, referring in greater detail to FIG. 3, pores 301 and 302 have substantially spherical contours and well-defined, rounded sides 305, showing that the pores are formed from and generally maintain the spherical shape of the bubbles formed in the foaming process.

In further reference to the porosity of the foamed abrasive article, embodiments have been characterized in terms of large pore fractions, $PF_x$, representing the fraction of pores within the foamed abrasive article having an average diameter greater than "x" microns. According to one embodiment, the foamed abrasive article has a $PF_{300}$ within a range between about 15% and about 50%. In certain other embodiments, $PF_{300}$ is at least about 20%, at least about 25%, or even at least about 30%.

According to another embodiment, the foamed abrasive article has a $PF_{450}$ within a range between about 5% and about 30%. In certain other embodiments, $PF_{450}$ is at least about 10%, such as at least about 12%, or even at least about 15%.

In accordance with yet another embodiment, the foamed abrasive article has a $PF_{750}$ within a range between about 1% and about 10%. In other embodiments, $PF_{7500}$ is not greater than about 8%, not greater than about 5%, or even not greater than about 2%.

As noted above, embodiments of the foamed abrasive article have a range of pore sizes that allows for a greater percentage of pores per unit volume while maintaining the structural integrity of the foamed abrasive, and thus a greater overall porosity within the final article. As such, in accordance with one embodiment, the foamed abrasive article has a porosity of at least about 66 vol %. More particularly, the porosity can be within a range between about 68 vol % and about 95 vol %, such as between about 75 vol % and about 95 vol %, or even within a range between about 77 vol % and about 90 vol %. In certain embodiments, the porosity is at least about 70 vol %, at least about 75 vol %, at least about 80 vol %, or even at least about 85 vol %.

While the foamed abrasive article has a significant pore volume, it is noteworthy that the article has sufficient mechanical performance for use in machining applications. For example, in one embodiment, the abrasive body has a Modulus of Rupture (MOR) within a range between about 1 MPa and about 20 MPa. In other embodiments, the MOR is at least about 3 MPa, at least about 5 MPa, or even at least about 8 MPa.

Referring now to FIGS. 4-10, various plots are provided demonstrating machining performance and parameters of a conventional bonded abrasive article as compared to the foamed abrasive article described herein. The machining tests performed to generate the plots illustrated in FIGS. 4-10 were completed on a metal workpiece. The testing was completed using an internal diameter machining test, conducted at a material removal rate of about 1 $mm^3/s/mm$. The conventional bonded abrasive article (CE1) is a Saint-Gobain bonded abrasive wheel containing sol-gel alumina grains, having a grade of L, and a M1 vitreous glass bond. The self-bonded foamed abrasive article (E1) included the same sol-gel alumina grains. Table 1 below details the composition and certain characteristics of the conventional bonded abrasive (CE1) as compared to the self-bonded foamed abrasive article.

TABLE 1

| | CE1 (Std) | E1 (Al. Foam) |
|---|---|---|
| Vol % Abrasive | 44% | 25% |
| Vol % Bond | 13% | 0% |
| Vol % Porosity | 43% | 75% |
| Avg. Grain Size (μm) | 130 | 1-20 |
| Density (g/cc) | 2.05 | 1.0 |

Figure 4:
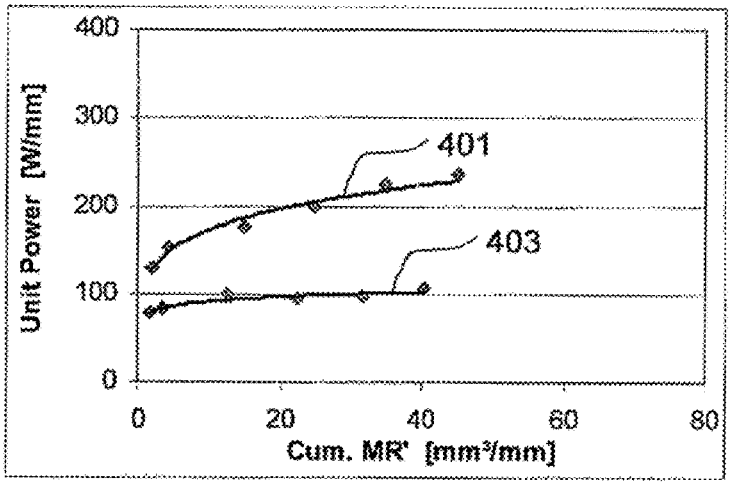
FIG. 4 illustrates a plot of power versus cumulative material removed for a conventional bonded abrasive and a foamed abrasive in accordance with an embodiment.

FIG. 4 illustrates unit power versus the cumulative material removed from a workpiece for the conventional bonded abrasive article versus the foamed abrasive article described herein. The plots show the frictional operation aspects of CE1 and E1, with higher unit power requirements being undesirable. Plot 401 is associated with CE1, while plot 403 is associated with E1. As illustrated in FIG. 4, the amount of power required to remove the same volume of material from the workpiece is notably higher for CE1, plot 401. As should be clear, the frictional losses associated with E1 are notably lower than CE1, resulting in more efficient material removal, less heat build-up and consequential thermal damage to the abrasive product and workpiece.

Figure 5:
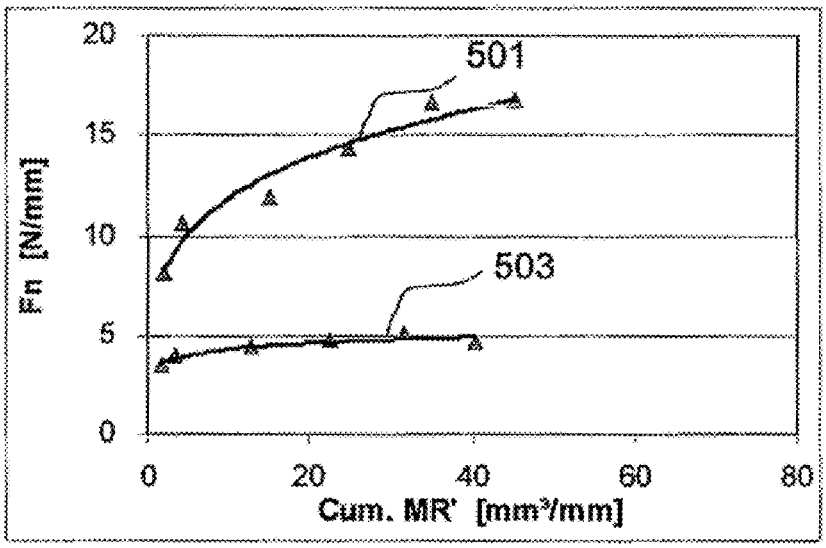
FIG. 5 illustrates a plot of force normal versus cumulative material removed for a conventional bonded abrasive and a foamed abrasive in accordance with an embodiment.
Figure 6:
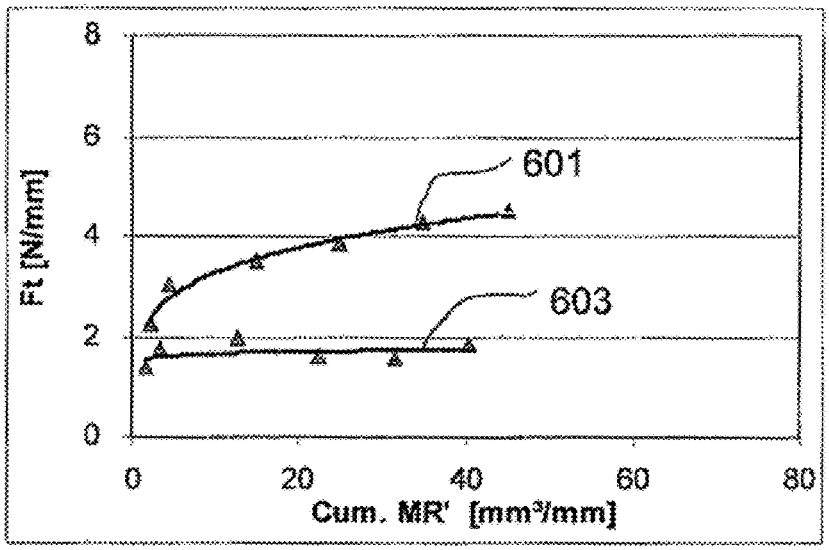
FIG. 6 illustrates a plot of force tangential versus cumulative material removed for a conventional bonded abrasive and a foamed abrasive in accordance with an embodiment.

FIGS. 5 and 6 illustrate a plot of the force normal versus the cumulative material removed from a workpiece, and a plot of force tangential versus cumulative material removed from a workpiece, respectively, for CE1 and E1. The plots of force versus cumulative material removed show the frictional operation aspects of CE1 and E1, noting that greater force requirements are unwanted. In FIG. 5, plot 501 is associated with CE1, while plot 503 is associated with E1. In FIG. 6, plot 601 is associated with CE1, while plot 603 is associated with E1. As illustrated, the amount of force applied to CE1 required to remove the same volume of material is substantially greater than that of E1 for both FIGS. 5 and 6. As illustrated in FIGS. 5 and 6, the force required for effective grinding associated with E1 is notably lower than CE1, resulting in more efficient material removal, less heat build-up and consequential thermal damage to the abrasive product and workpiece.

Figure 7:
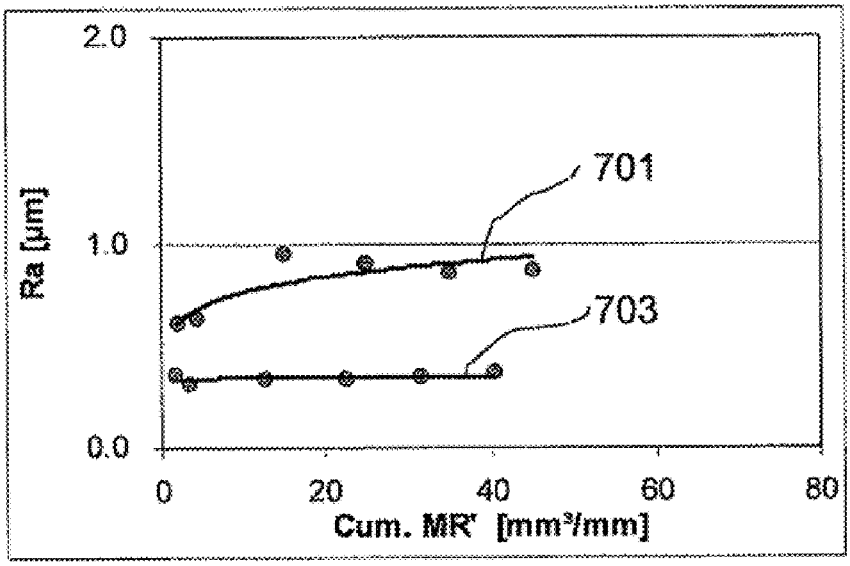
FIG. 7 illustrates a plot of averaged surface roughness versus cumulative material removed for a conventional bonded abrasive and a foamed abrasive in accordance with an embodiment.
Figure 8:
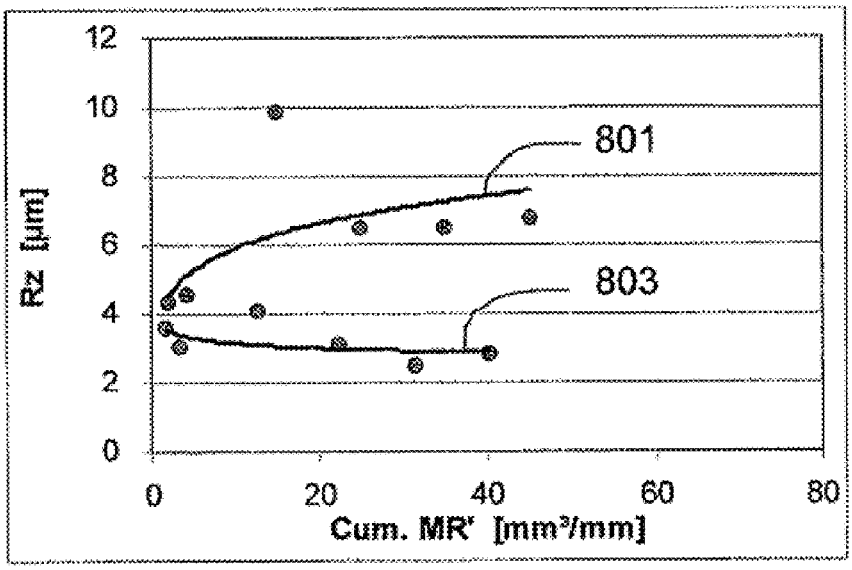
FIG. 8 illustrates a plot of root mean squared surface roughness versus cumulative material removed for a conventional bonded abrasive and a foamed abrasive in accordance with an embodiment.

FIGS. 7 and 8 illustrate plots of averaged surface roughness ($R_a$) versus cumulative material removed, and root mean squared surface roughness ($R_z$) versus the cumulative material removed, respectively, for CE1 and E1. The plots of surface roughness versus cumulative material removed show the polishing effectiveness of CE1 and E1, with greater surface roughness being less suitable in a machined workpiece. In FIG. 7, plot 701 is associated with CE1, while plot 703 is associated with E1. In FIG. 8, plot 801 is associated with CE1, while plot 803 is associated with E1. As illustrated in both FIGS. 7 and 8, CE1 demonstrates an increase in the surface roughness, such that with greater polishing the surface of the workpiece becomes rougher. By contrast, E1 demonstrates a substantially constant averaged surface roughness, and in fact, a decrease in root mean squared surface roughness with increased material removed. As should be clear in FIGS. 7 and 8, the change of the surface roughness associated with E1 is notably lower than CE1, resulting in superior surface finish as a function of material removed.

Figure 9:
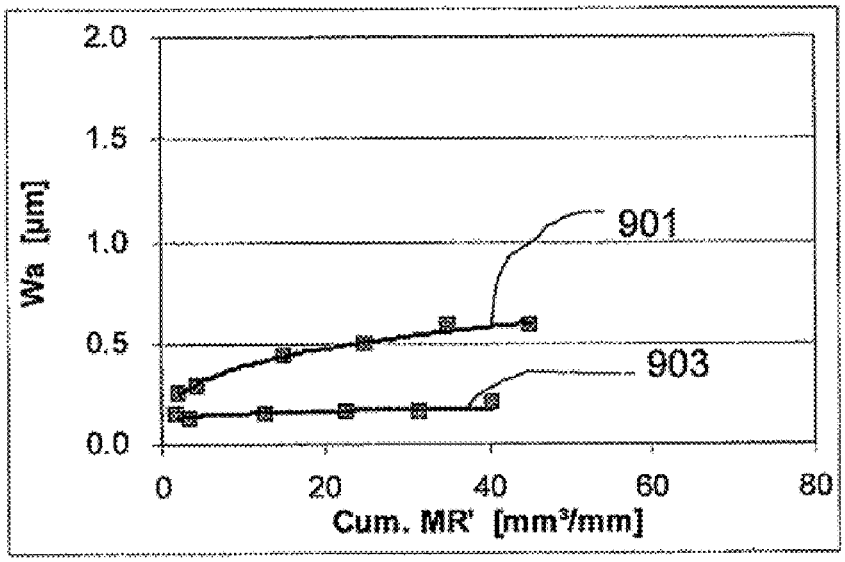
FIG. 9 illustrates a plot of averaged waviness versus cumulative material removed for a conventional bonded abrasive and a foamed abrasive in accordance with an embodiment.
Figure 10:
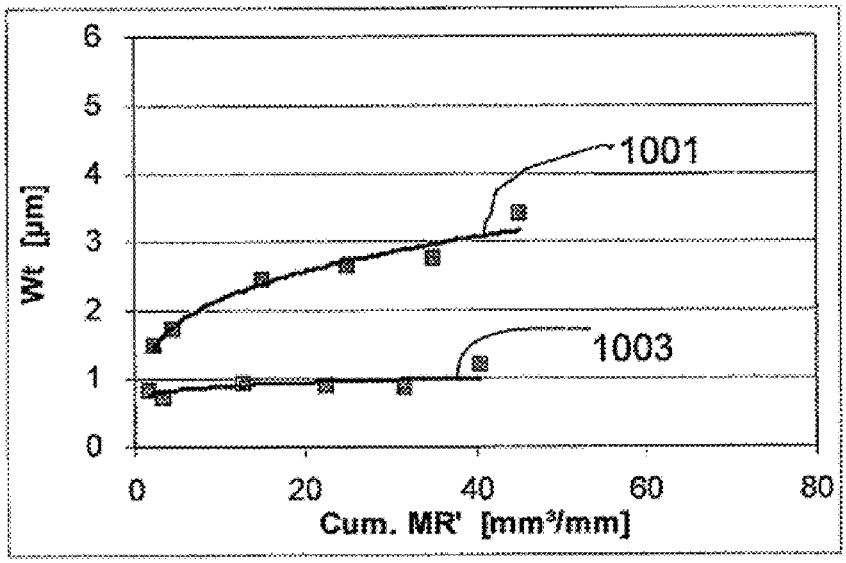
FIG. 10 illustrates a plot of total waviness versus cumulative material removed for a conventional bonded abrasive and a foamed abrasive in accordance with an embodiment.

FIGS. 9 and 10 illustrate a plot of averaged waviness ($W_a$) of a work surface versus the cumulative material removed, and total waviness ($W_t$) of a work surface versus the cumulative material removed, respectively, for CE1 and E1. The plots of averaged waviness versus cumulative material removed show the polishing effectiveness of CE1 and E1, with greater waviness being undesirable. In FIG. 9, plot 901 is associated with CE1, while plot 903 is associated with E1. In FIG. 10, plot 1001 is associated with CE1, while plot 1003 is associated with E1. As illustrated, CE1 has a greater increase in the waviness of the workpiece for the same volume of material removed as compared to E1. With respect to dimensional control of the workpiece as a function of material removal, FIGS. 9 and 10 illustrate that E1 is superior to CE1 for efficient material removal while maintaining a smoother surface.

Figure 11:
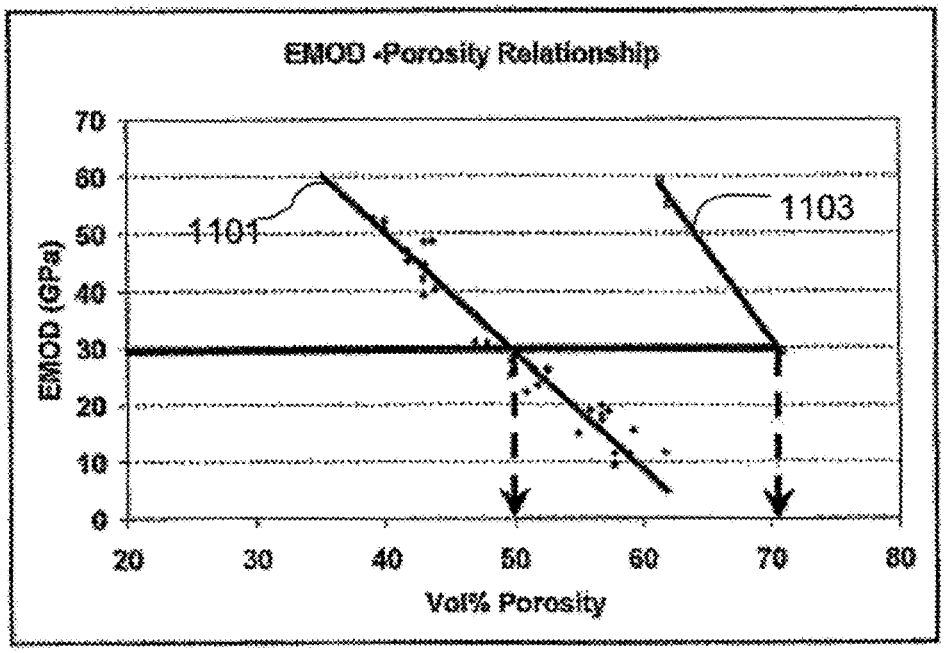
FIG. 11 illustrates a plot of elastic modulus (EMOD) versus volume percent porosity for a conventional bonded abrasive and a foamed abrasive in accordance with an embodiment.
Figure 12:
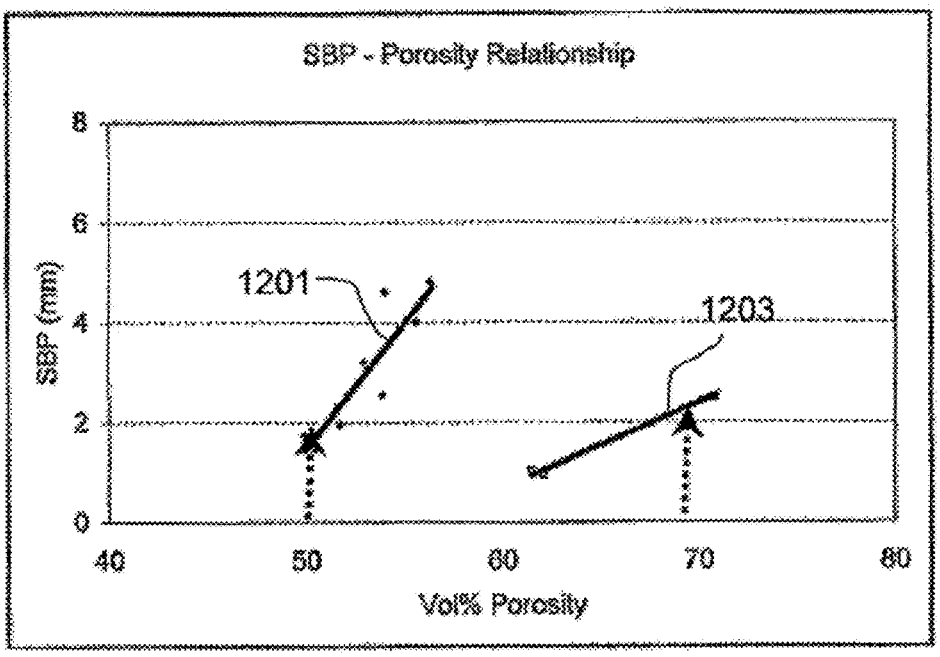
FIG. 12 illustrates a plot of sand blast penetration (SBP) versus volume percent porosity for a conventional bonded abrasive and a foamed abrasive in accordance with an embodiment.

FIGS. 11 and 12 further demonstrate the differences between present embodiments and conventional bonded abrasives. Notably, FIGS. 11 and 12 demonstrate improved stiffness and hardness of the foamed abrasive articles over conventional bonded abrasive products, which in light of the highly porous structure, is quite unexpected.

FIG. 11 illustrates two plots of elastic modulus (EMOD) versus percent porosity for CE1 and E1. Plot 1101 is associated with the conventional bonded abrasive (CE1), while plot 1103 is associated with the foamed abrasive (E1). As illustrated, E1 has a greater stiffness for a given porosity as compared to CE1 and accordingly has greater stiffness with improved porosity, which is desirable for grinding applications. For example, CE1 has a porosity of 50% at an EMOD value of 30 GPa, while E1 can have a porosity of 70% at the equivalent EMOD value (30 GPa). Thus E1 is capable of providing greater swarf removal capabilities through the highly porous and interconnected porosity while providing greater or at least comparable stiffness.

FIG. 12 illustrates two plots of sand blast penetration (SBP) versus percent porosity for CE1 and E1. Generally, the sand blast penetration test is performed in the abrasives industry to measure the hardness of an abrasive product, or otherwise the products wear resistance. As illustrated by CE1, as the porosity of a conventional bonded abrasive product increases, the hardness decreases and the wear resistance increases. By comparison, E1 demonstrates that for a significantly greater porosity, the wear resistance is substantially less than CE1. Moreover, the wear resistance of E1 does not increase as fast with increasing porosity as CE1 demonstrating improved wear resistance over a greater range of porosities and higher range of porosities. Thus E1 is capable of providing greater swarf removal capabilities through the highly porous and interconnected porosity while providing greater wear resistance.

FIGS. 13-16 illustrate abrasive tools having a foamed abrasive structure in accordance with embodiments herein. Notably, the present abrasive tools can be shaped in the form of abrasive wheels, or more broadly, rotational structures, having an opening or "arbor hole" extending through a central portion of the abrasive tool for engagement with a chuck or fixture for connection to a grinding machine. As will be appreciated and further illustrated, the abrasive tools can be in the form of disks, cones, cups, and the like. In these various configurations, an outer contour of the tool lying in a cross-sectional plane extending perpendicular to the central axis extending through the arbor hole, is generally circular. In certain abrasive tool structures, the body of the foamed abrasive structure within the plane can be a continuous structure of foamed abrasive material extending through the circumference around the central axis. Still, in particular embodiments, the tool can have a discontinuous structure, for example, the tool can have a segmented structure in which a plurality of foamed abrasive segments are bonded to a substrate in a generally circular pattern.

Figure 13:
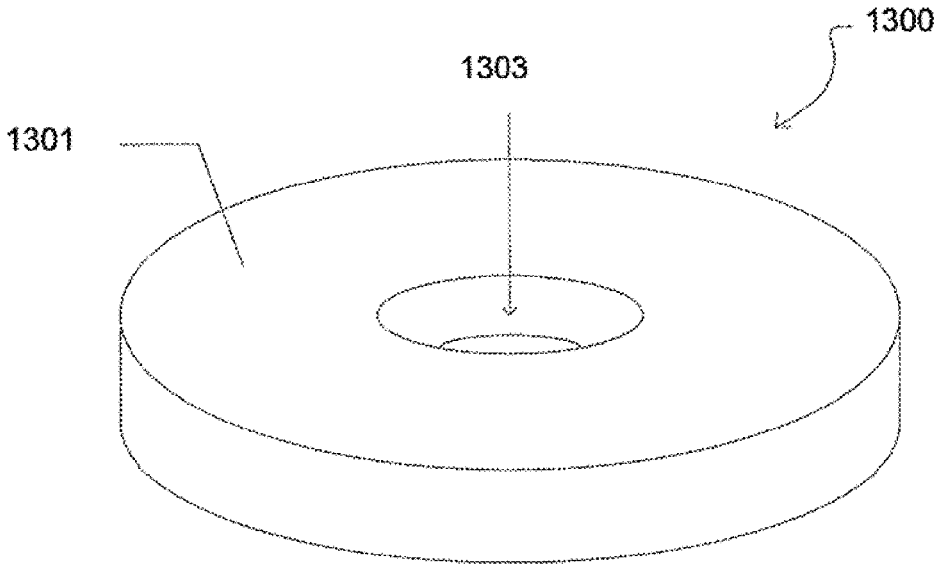
FIG. 13 illustrates a perspective view of an abrasive tool in accordance with an embodiment.

Accordingly, referring to FIG. 13, a perspective view of an abrasive tool is illustrated in accordance with an embodiment. As illustrated, the abrasive tool 1300 includes a foamed abrasive body 1301 shaped in the form of a disk. The abrasive tool 1300 further includes an opening 1303 extending through a center of the abrasive body 1301 defining a rotational axis such that the abrasive body can be rotated during grinding applications. The opening 1303 is also configured for engagement with a chuck, such that the abrasive body 1301 can be coupled to a grinding machine. In such instances, the chuck can include a clamp or other assembly that grasps the abrasive body by extending through the opening 1303 and engaging the abrasive body 1301 on both sides of the opening 1303 fixing the abrasive body to the grinding machine.

Figure 14:
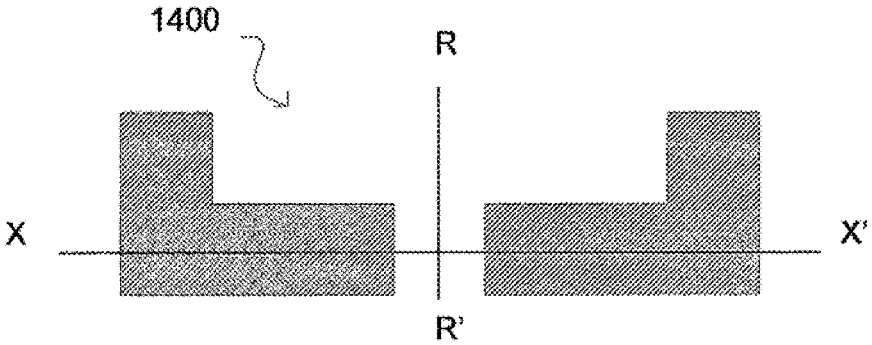
FIG. 14 illustrates a cross-sectional view of an abrasive tool in accordance with an embodiment.
Figure 15:
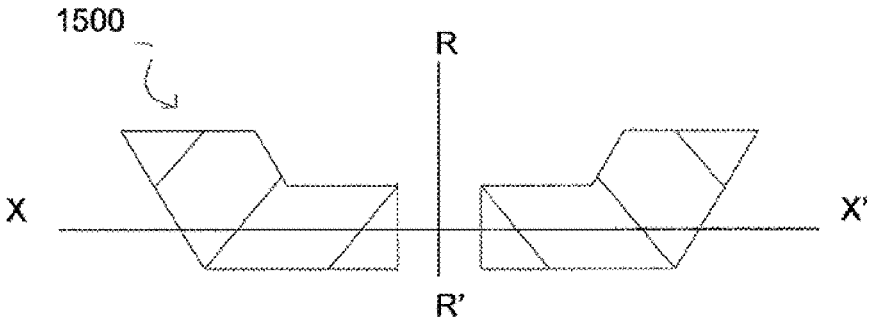
FIG. 15 illustrates a cross-sectional view of an abrasive tool in accordance with an embodiment.

As further illustrated in the cross-sectional views of FIGS. 14 and 15, the abrasive body can have other shapes, such as a cup 1400, cone 1500, or the like. In such embodiments, the abrasive body can further include flanges that define a recess. As in other embodiments, the abrasive body includes an opening extending through the body and defining a rotational axis (r) for engagement with a chuck or fixture. Cross-sectional plane x-x', perpendicular to the rotational axis (r), contains an outer periphery that is generally circular.

Figure 16:
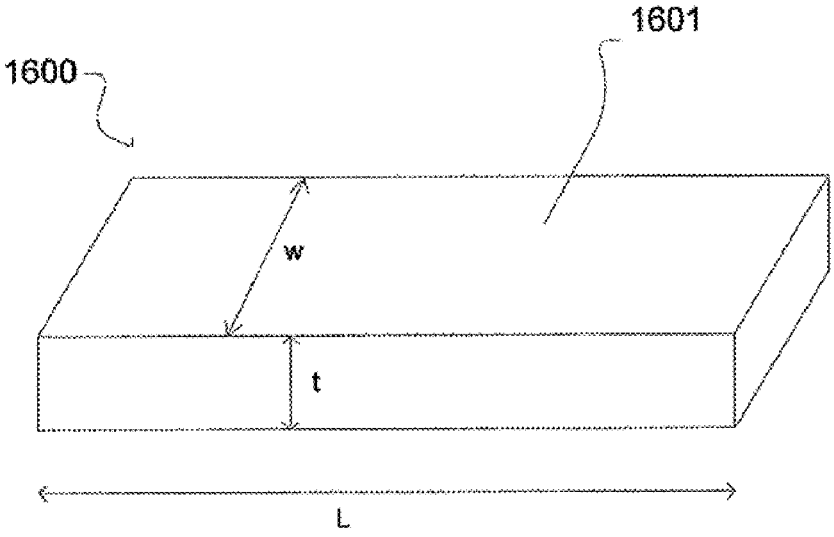
FIG. 16 illustrates a perspective view of an abrasive tool in accordance with an embodiment.

FIG. 16 includes a perspective view of an abrasive tool in accordance with an embodiment. As illustrated, the abrasive tool 1600 includes a foamed abrasive body 1601. Moreover, in accordance with one embodiment, the abrasive article has dimensions of length, width, and thickness, wherein the length<the width≦the thickness. In one particular embodiment, the abrasive body 1601 has a primary aspect ratio defined as the ratio of length to the thickness of not less than about 2:1, such as not less than about 3:1, 5:1, or even not less than about 10:1. The abrasive body can further have a second aspect ratio defined as the ratio of the length to the width. In such certain embodiments, the secondary aspect ratio can be not less than about 2:1, not less than about 3:1, 4:1, or even not less than about 5:1. In certain embodiments, the secondary aspect ratio is not greater than about 10:1.

In reference to actual dimensions, in certain embodiments, the length (l) of the abrasive body 1601 is not greater than about 25 cm, such as not greater than about 20 cm, and more particularly within a range between 6 cm and about 20 cm. In certain other embodiments, the width (w) of the abrasive body 1601 is not greater than about 10 cm, such as not greater than about 8 cm, and particularly within a range between about 2 cm and about 6 cm. With respect to the thickness (t) of such abrasive tools, in accordance with certain embodiments, the thickness is not greater than about 5 cm, such as not greater than about 4 cm, and particularly within a range between about 0.5 cm and about 3 cm.

As further illustrated in FIG. 16, the abrasive body 1601 can have a cuboid shape (rectangular prism) such that in certain embodiments, the abrasive body 1601 has a rectangular cross-sectional contour as defined by the dimensions of thickness (t) and width (w). Still, in other embodiments, the abrasive body 1601 can have a square cross-sectional contour.

Figure 17:
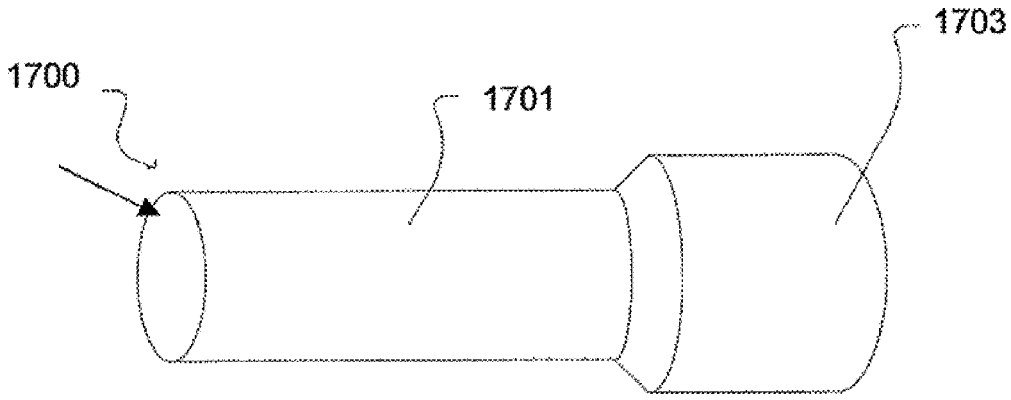
FIG. 17 illustrates a perspective view of an abrasive tool in accordance with an embodiment.

Still, as illustrated in FIG. 17, the abrasive tool 1700 can have a cylindrical shape, such that the abrasive body 1701 can have a circular cross-sectional shape. Additionally, as illustrated, the abrasive tool 1700 includes an end portion 1703 that is configured for engagement with a fixture or chuck of a grinding machine to couple the abrasive tool 1700 to a grinding machine. In accordance with one particular embodiment, the abrasive tool 1700 includes an end portion 1703 that has dimensions different than that of the abrasive body 1701 for suitable coupling with a chuck or fixture of a grinding machine. As illustrated in FIG. 17, the end portion 1703 has dimensions greater than those of the abrasive body 1701. Still, in an alternative embodiment, the end portion 1703 can have dimensions that are smaller than those of the abrasive body 1701.

It will further be appreciated that the abrasive tools described herein can include one or more features of one or more embodiments described herein. For example, an abrasive tool having the combined geometries of FIGS. 16 and 17 may be formed, such that the abrasive tool has a portion that has a rectangular shape and a portion having a cylindrical shape.

Figure 18:
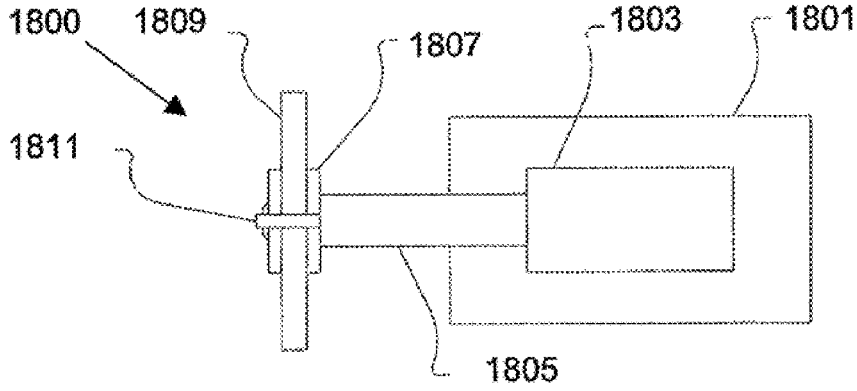
FIG. 18 illustrates a cross-sectional view of an abrasive tool including a grinding machine in accordance with an embodiment.

Referring to FIG. 18, a cross-sectional illustration of a grinding machine is provided. The grinding machine 1800 includes a housing 1801 having a motor 1803 contained within the housing 1801 and an arm 1805 connected to the motor 1803 at one end. At the end of the arm 1805 opposite the end connected to the motor 1803, the arm 1805 is connected to a chuck 1807, which is configured to engage and connect to a foamed abrasive tool 1809 in accordance with embodiments herein.

As further illustrated in FIG. 18 and in accordance with one embodiment, the chuck can 1807 can include two plates, designed to engage opposite major surfaces of the abrasive tool 1809 and connect the abrasive tool 1809 to the arm 1805. As further illustrated, the chuck 1807 can include a bolt 1811 configured to extend through an opening (e.g., the arbor hole) in the abrasive tool 1809 providing a compressive force on the plates and securing the abrasive tool 1809 within the chuck 1807. It will be appreciated however, that other chucks may be utilized.

During operation, the motor 1803 can be operated to rotate the arm 1805. Given the connection of components illustrated and described above, rotation of the arm 1805 facilitates rotation of the abrasive tool 1809 which facilitates a grinding or polishing process when a workpiece is contacted with the rotating abrasive tool 1809. It will be appreciated that FIG. 18 illustrates a grinding machine incorporating a grinding wheel abrasive tool, however, for other such shapes and configurations of abrasive tools described herein, other suitable chucks can be used.

Methods of machining a workpiece using a highly-porous, foamed abrasive article have been disclosed herein that represent a departure from the state-of-the-art. Traditionally, ceramics having such high porosity, especially self-bonded abrasives, were thought to be limited in their application to filters and catalyst support materials, given that such large volumes of porosity would not provide the mechanical durability necessary for abrasive applications. Moreover, while it has been suggested that self-bonded ceramics, and more particularly reticulated ceramics formed by casting a ceramic slurry, may be suitable for machining applications, the porosity of these articles has generally been limited to less than 65 vol %, (See for example, U.S. Pat. No. 5,221,294) since structures having greater porosity would lack the requisite durability to facilitate a machining process.

However, it has been discovered that the self-bonded foamed abrasive articles according to embodiments herein have porosity in excess of 65 vol % and is not only suitable for machining applications, but provides exceptional performance. Without wishing to be tied to any particular theory, the inventors note that the foamed abrasive article has a substantially different porosity than conventional structures. In particular, the size of the pores within the foamed abrasive article vary on an order of at least an order of magnitude, if not two orders of magnitude, between the smallest and largest pores. Moreover, the shape of the pores are well-defined, being substantially spherical (i.e., bubble-like) and having smooth, curved surfaces. The shape of the bubble-like pores, in combination with the variety of sizes allows for close packing of pores per unit volume, and therefore a higher porosity in the overall structure. Additionally, the close-packed nature of the pores allows for a greater percentage of interconnected porosity within the structure as compared to conventional materials. The combination of such features allows for the creation of a self-bonded foamed abrasive article that is unexpectedly strong and resistant to mechanical breakdown, which is particularly suitable for machining, and particularly polishing applications. While such self-bonded foamed abrasive materials have been developed and deployed for use in industrial applications, such as refractory applications, the state-of-the-art has not used such materials for abrasive applications. This is not surprising given the poor performance of conventional abrasive products with increasing porosity as reported in, for example, U.S. Pat. No. 5,221,294. Accordingly, it was unexpected to discover that highly-porous, self-bonded, foamed abrasives according to embodiments herein not only have effective abrasive properties, but have such notable performance.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A method of machining comprising:

providing a workpiece having a worksurface; and removing material from the worksurface by moving an abrasive relative to the worksurface, wherein the abrasive comprises a self-bonded foamed abrasive body comprising abrasive grains and a porosity of at least about 70 vol %.

2. The method of claim 1, wherein the porosity is within a range between about 75 vol % and about 95 vol %.

3. The method of claim 1, wherein the abrasive grains are selected from the group of materials consisting of oxides, borides, nitrides, carbides, and any combination thereof.

4. The method of claim 1, wherein the self-bonded foamed abrasive body comprises pores having an average size of at least about 1 micron.

5. The method of claim 4, wherein the self-bonded foamed abrasive body comprises a fraction of pores having an average diameter greater than 300 microns ($PF_{300}$) of at least about 15%.

6. The method of claim 4, wherein the self-bonded foamed abrasive body comprises a fraction of pores having an average diameter greater than 450 microns ($PF_{450}$) of at least about 5%.

7. The method of claim 4, wherein the self-bonded foamed abrasive body comprises a fraction of pores having an average diameter greater than 750 microns ($PF_{750}$) of not greater than about 10%.

8. The method of claim 1, wherein the self-bonded foamed abrasive body has a thickness greater than about 60 mm.

9. An abrasive tool comprising:

a self-bonded foamed abrasive body having abrasive grains and a porosity of at least about 70 vol %, wherein the abrasive body is configured for engagement with a chuck of a grinding machine.

10. The abrasive tool of claim 9, wherein the abrasive body has a circular cross sectional contour.

11. The abrasive tool of claim 9, wherein a coupling portion of the abrasive body comprises an opening extending through a center of the abrasive body and defining a rotational axis of the abrasive body, the opening configured for engagement with the chuck of a grinding machine.

12. The abrasive tool of claim 9, wherein the abrasive body has an elongated shape defined by a length, width, and thickness.

13. The abrasive tool of claim 12, wherein the length<the width≦the thickness and the abrasive body has a primary aspect ratio defined as the ratio of length to the thickness of not less than about 2:1.

14. An abrasive tool comprising:

a self-bonded foamed abrasive body having abrasive grains and a porosity of at least about 70 vol %; and an opening extending through a center of the abrasive body and defining a rotational axis of the abrasive body, the opening configured for engagement with a chuck of a grinding machine.

15. The abrasive tool of claim 14, wherein the porosity is within a range between about 75 vol % and about 95 vol %.

16. The abrasive tool of claim 14, wherein the porosity includes individually identifiable pores having substantially spherical shapes, which substantially contact adjacent pores forming an interconnected network of pores.

17. The abrasive tool of claim 14, wherein the self-bonded foamed abrasive body comprises pores having an average size of at least about 1 micron.

18. The abrasive tool of claim 17, wherein the self-bonded foamed abrasive body comprises pores having an average size within a range between about 10 microns and about 2000 microns.

* * * * *

UNITED STATES PATENT AND TRADEMARK OFFICE

CERTIFICATE OF CORRECTION

PATENT NO. : 8,357,028 B2
APPLICATION NO. : 12/484059
DATED : January 22, 2013
INVENTOR(S) : Muthu Jeevanantham et al.

It is certified that error appears in the above-identified patent and that said Letters Patent is hereby corrected as shown below:

On the title page, item (73) Assignees, please delete "SAINT-GOBAIN ABRASIVE, INC." and insert therefor -- SAINT-GOBAIN ABRASIVES, INC. --.

Signed and Sealed this
Fifth Day of August, 2014

Michelle K. Lee

Michelle K. Lee
*Deputy Director of the United States Patent and Trademark Office*